United States Patent [19]

Petrey

[11] Patent Number: 4,651,354

[45] Date of Patent: Mar. 24, 1987

[54] FOOT COVER

[76] Inventor: John O. Petrey, 16955 Blackhawk, #15, Granada Hills, Calif. 91344

[21] Appl. No.: 724,738

[22] Filed: Apr. 18, 1985

[51] Int. Cl.[4] ..... A41B 11/02; A43B 17/00

[52] U.S. Cl. ..... 2/239; 36/9 R

[58] Field of Search ..... 36/9 R, 11, 14, 10, 36/8.1, 1, 102, 103, 106, 113, 8.3, 59 R, 58.5; 2/239, 161 A, 161 R, 241, 240, 242

[56] References Cited

U.S. PATENT DOCUMENTS

| | | | |
|---|---|---|---|
| 266,614 | 10/1882 | Douglass | 36/8.1 X |
| 387,035 | 7/1888 | Basch | 36/8.1 |
| 1,308,483 | 7/1919 | Craighead | 2/239 |
| 1,452,302 | 4/1923 | Loven | 2/239 |
| 2,538,673 | 1/1951 | Donahue | 36/9 R |
| 3,383,782 | 5/1968 | McGinnity | 36/9 R |
| 3,649,967 | 5/1972 | Millman | 2/161 A |
| 4,021,860 | 5/1977 | Swallow et al. | 2/239 |
| 4,038,787 | 8/1977 | Bianchi | 2/161 R X |
| 4,149,274 | 4/1979 | Garrou et al. | 2/239 |
| 4,206,514 | 6/1980 | Yamauchi | 2/239 |

FOREIGN PATENT DOCUMENTS

| | | | |
|---|---|---|---|
| 2036360 | 12/1970 | France | 36/9 R |
| 744210 | 2/1956 | United Kingdom | 2/239 |
| 1439641 | 6/1976 | United Kingdom | 36/9 R |

*Primary Examiner*—Werner H. Schroeder
*Assistant Examiner*—T. G. Graveline
*Attorney, Agent, or Firm*—Nilsson, Robbins, Dalgarn, Berliner, Carson & Wurst

[57] ABSTRACT

A lightweight foot garment which is made from a tubular shaped material to cover a human foot. The tubular shaped material being stretchably tight and snug fitting around the foot. An adhesive is applied to the bottom portion of the tubular shaped material such that the adhesive is soft and sticky-like when first applied then hardening into a gripping or non-skid type of material, thus forming the bottom of the foot garment. Alternatively, a smooth pad or non-skid type of material such as ground rubber or plastic may be applied to the bottom portion of the tubular shaped material, with the adhesive applied to secure the smooth pad or non-skid type of material to the tubular shaped material.

13 Claims, 8 Drawing Figures

FIG. 1
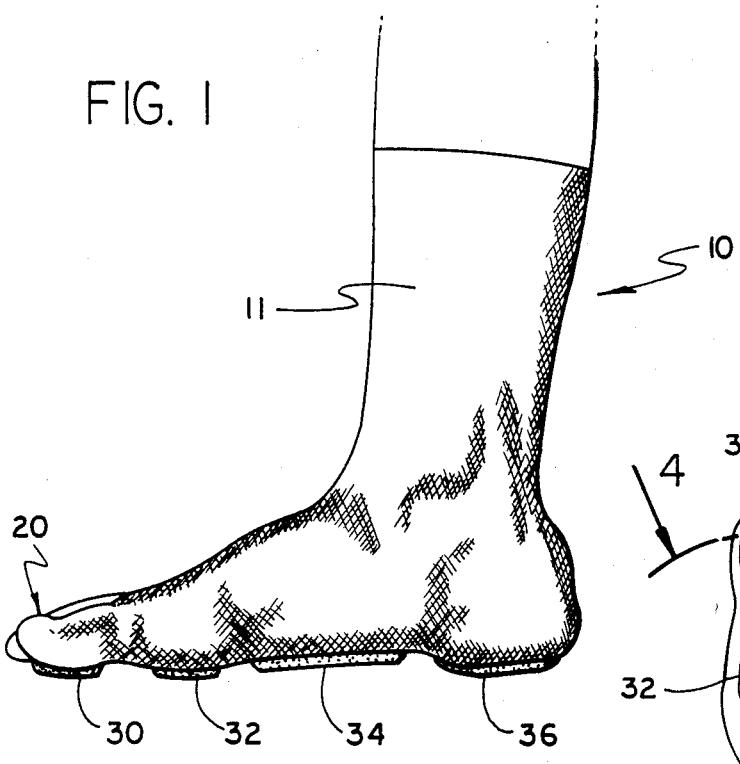
FIG. 2
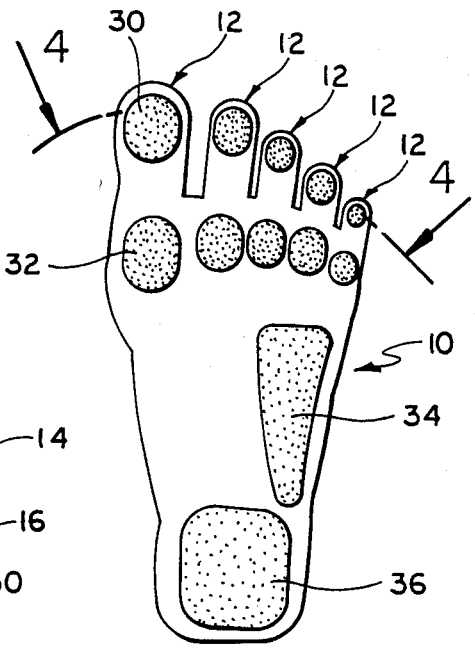
FIG. 3
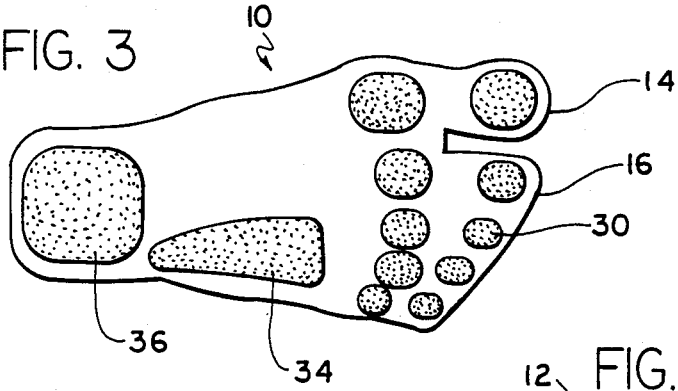
FIG. 4
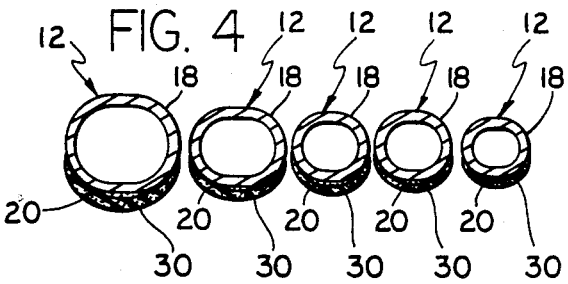
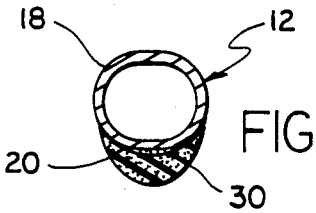
FIG. 5
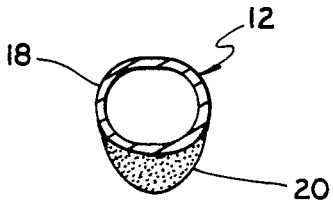
FIG. 6
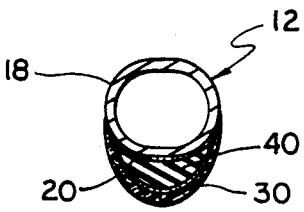
FIG. 7
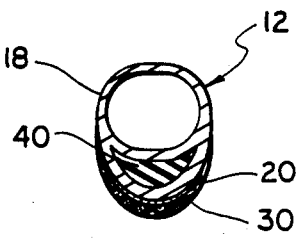
FIG. 8

FOOT COVER

FIELD OF THE INVENTION

The present invention generally relates to a foot garment and, more particularly, is concerned with providing the human foot with the individual gripping action of the toes and barefoot when contacting the ground and at the same time providing the protection of a shoe. A stretchable tubular shaped material or fabric that is tight and snug fits around a human foot. An adhesive is applied to the bottom of the material or fabric with the adhesive hardening into a gripping or non-skid type of element, thus forming the bottom of the foot garment.

DESCRIPTION OF THE PRIOR ART

Running speed is important in many athletic events particularly track and field. It has been discovered that wearing track shoes slows a runner down, particularly on the synthetic track surfaces currently being utilized. This is because the runner must pull the spikes out of the synthetic surface when running and thus must overcome the friction and suction of the spikes when it contacts the surface. Many times runners in their bare feet tend to be able to run faster than those runners wearing shoes with the traditional spikes.

There have been many inventions to improve the foot stocking or shoe. For example, U.S. Pat. No. 1,308,483 to Craighead discloses an improved foot stocking which incorporates separate stalls for each toe.

A foot correcting inner slipper to correct deformities of the large toe or toes is disclosed by Levey in U.S. Pat. No. 3,013,564. The inner slipper is also comfortable to the wearer, easy to put on and take off. The inner slipper also provides an arch support with a sock or stocking disposed within the slipper to provide an inner lining for the slipper. The sock, inner slipper combination also providing a separate toe encasing portion for the large toe and a separate toe encasing portion for the rest of the toes.

U.S. Pat. No. 3,128,763 to Lengenfeld discloses a stocking with separate stalls for each toe and in addition thereto a pad or tubular strip around each of the stalls to prevent a number of foot ills or discomforts such as chafing, fungus growth, irritation or excessive perspiration. The pad also permitting the application of medication to points between the toes or around the toes.

An improved version for a shoe with individual compartments for the toes is disclosed in U.S. Pat. No. 3,967,390 to Anfruns. Each toe compartment has a separate sole portion, a separate upper portion, and a flexible strip disposed around and between the toe compartments. An indentation is extended into the sole to provide flexing of the separate tool compartments. The sole is usually made of a strong, natural leather or synthetic plastic, and the upper portions are usually made of leather. As a result of the toe compartments flexible construction the toe compartments are free to be independent therefore improving the toe compartments contact with the ground.

The above inventions provide better protection for the individual toes and foot, are more comfortable and provide better foot and toe contact with the ground. However, they are for casual wear and not for athletic events which require much more from a foot garment. Therefore, there is still a current need for a foot garment that is lightweight, which protects the feet, allows the individual toes and feet to engage and grip the ground, and to prevent the toes and feet from sliding within the foot garment when it is being used.

SUMMARY OF THE INVENTION

A lightweight foot garment which is tight and snug around the foot and providing the individual toes and feet to grip the ground.

BRIEF DESCRIPTION OF THE DRAWINGS

FIG. 1 is a side view of the present invention.

FIG. 2 is a bottom view of one embodiment of the present invention.

FIG. 3 is a bottom view of one embodiment of the present invention.

FIG. 4 is a cross sectional view taken along lines 4—4 in FIG. 2.

FIG. 5 is a cross sectional view of an individual toe compartment with one form of a spike.

FIG. 6 is a cross sectional view of an individual toe compartment with another form of a spike.

FIG. 7 is a cross sectional view of an individual toe compartment with another form of a spike.

FIG. 8 is a cross sectional view of an individual toe compartment with another form of a spike.

DETAILED DESCRIPTION OF THE PREFERRED EMBODIMENT

The present invention is an improvement of a garment to be worn on the human foot. The present invention will provide a wearer the gripping and control of barefoot while at the same time providing protection as if wearing a shoe. The present invention also would prevent the foot from sliding within the garment which would result in discomfort and a number of foot ills such as blisters and chafing. A particular application for the present invention is track and field events, particularly running. For example, a runner usually likes to carry as little weight as possible to run faster but yet not be inconvenienced or discomforted by the savings in weight. When a runner wears track shoes he must work against the force of the weight of the shoes and he must overcome the gripping force of the spikes or sole of the shoe on the track surface. Additionally, the foot within the shoe tends to slide back and forth therefore causing, without proper protection, a number of foot ills such as blisters and chafing. If a runner does not wear shoes and runs barefoot, he has less weight and less frictional forces to overcome and gains more control but loses the protection of wearing a shoe.

The present invention provides the benefits of running barefoot and at the same time provides the protection of wearing a shoe. A lightweight stretchable sock is worn by the runner instead of a shoe. A plurality of gripping type of material is disposed at key areas on the bottom of the sock or across the entire bottom of the sock to provide the gripping and control of runners in their barefeet. An adhesive is used to secure the pads to the sock or can be used alone to provide the gripping pads.

FIG. 1 shows the present invention from a side view. The sock 10 is made of a stretchable fabric but yet fits tight on the foot. The lower leg portion of the sock 11 may be as low as the ankle or as high as the knee. A plurality of pads 30, 32, 34 and 36 are disposed on the bottom portion of the sock at key locations where the foot contacts the ground. These pads are secured to the sock by an adhesive 20 such as hot melt glue. The pads are made of any gripping or non-skid type of material such as ground rubber particles.

Alternatively, the hot melt glue could be allowed to dry and harden without applying the ground rubber particles to it. Therefore, the hot melt glue would form the gripping pads. If additional support is required to prevent the foot from sliding within the sock, a bandage or any wrapping material may be wrapped around the ankle and foot to provide such support. If wrapping is desired, a sports medicine specialist should be consulted first.

Referring to FIG. 2, the sock is constructed such that there are individual stalls or compartments 12 for each toe. To provide the gripping and control of the bare foot, pads are disposed directly under each toe 30, at the base of each toe 32, on the side opposite the arch of the foot 34 and at the heel 36. Constructing the sock with individual stalls or toe compartments would allow independent and free movement of each toe therefore maximizing the gripping and control of the foot.

FIG. 3 shows the sock 10 constructed such that there is an individual compartment for the large toe 14 and an individual compartment for the rest of the toes 16. The pads are disposed similar to that in FIG. 2. However, the pads 32, 34 and 36 may be disposed to cover the entire bottom of the foot (not shown) or a unitary one piece pad may be disposed to cover the entire bottom of the sock (not shown).

The actual placement of the pads will vary from individual to individual and a pair of socks can be custom made for each person if it is desired. However, for mass production purposes, the pads may be placed at the positions where the average persons foot contacts the ground. Many methods can be used to locate the critical points on the bottom of the foot which makes contact with the ground. For example, a person may stand barefoot on a section of glass with a mirror placed at an angle to the glass such that the bottom of the foot may be observed through the glass. While standing on the glass, certain portions on the bottom of the foot will be more pale than other portions foot. This would indicate the areas which the weight of the body is distributed across the bottom of the foot. These areas could be sufficient to determine the placement of the pads. However, if a scope is used in conjunction with the glass and mirrors, the specific areas which the foot makes contact with the glass is indicated and could then be recorded and transfered to the bottom portion of the sock where the pads will be appropriately placed. Alternatively, a mold can be made for an individual foot to indicate the critical points. The thickness of the pads may also vary depending on the individual and the particular use of the sock.

The stretchable fabric 18 as shown in FIG. 4 can also vary in thickness depending on the protection desired by the wearer and the type of activity engaged by the wearer. Additionally, a soft pad or arch support may be placed within the sock for comfort. The bottom portion of each individual toe compartment 12 is sprayed or manually applied such as by spatula with the adhesive 20. In addition to hot melt glue, a variety of adhesives may be applied. For example, hot melt plastic or vinyls, or a wax-like substance may be used. The ground rubber particles 30 are then applied to the adhesive 20 before the adhesive hardens. In addition to ground rubber a variety of other materials may be used such as cork, many plastics, and polyethylene. In the event the ground rubber particles or other material are not positioned correctly, the adhesive may be reheated and the ground rubber particles or material may be moved to the proper position.

Depending on the activity engaged by the person, it may be desired to incorporate spikes on the bottom of the sock. This can be accomplished a variety of ways. The ground rubber particles 30 may be built up on the hot melt glue 20 such that the ground rubber particles forms a spike-shaped element as shown in FIG. 5. Alternatively, the hot melt glue itself 20 may be built up to form a spike-shaped element as shown in FIG. 6. Alternatively, a metal or nylon spike 40 may be applied to the hot melt glue 20 before it hardens, and an additional coat of hot melt glue 20 applied over the metal or nylon spike 40. The hot melt glue 20 could then be allowed to harden or the ground rubber paticles 30 may be applied to the hot melt glue 20 before it hardens. This is shown in FIG. 7. Also, the metal or nylon spike 40 may be embedded within the stretchable material 18. The hot melt glue 20 is then applied to the sock and either allowed to harden or ground rubber particles 30 may be applied to the hot melt glue 20 before it hardens. This is shown in FIG. 8.

Although the particular activity used as an example was running, and track and field events, there are many other uses for the present invention. For example, in sports the present invention may be used in gymnastics especially the balance beam, tennis, softball, baseball, and football, especially for a wide receiver. Additionally, the present invention may be used by rock climbers. However, if such is desired, it will be necessary to dispose gripping pads on the medial or lateral side or both sides of the sock. These additional pads provides a rock climber with more protection and more gripping surfaces when climbing. The present invention may also be used in aerobics and in industry. For example, roofers may use the present invention because it is essential for their feet to have a proper grip on the surface (the roof).

The present invention may also be modified such that a smooth or slippery material is substituted for the non-skid material. A particular application for this substitution is bowling where balance is important and a slippery or sliding surface on the bottom of the foot is required. Additionally, the present invention may be worn within a normal shoe, if such is desired.

The present invention provides the gripping action of a barefoot, enhances the foot contact surface compared to the barefoot, is lighter than wearing a shoe, and yet provides the protection of wearing a shoe.

The form described is merely a preferred or exemplary embodiment and it is apparent that various changes may be made by those skilled in the art without departing from the spirit and scope of the invention.

What is claimed is:

1. A lightweight foot garment comprising:

a tubular shaped material to cover a human foot;

said tubular shaped material being stretchably tight and snug fitting around the foot;

said tubular shaped material having a bottom portion;

an adhesive applied to only specific areas of said bottom portion of said tubular shaped material such that said adhesive is malleable when first applied then hardens into a first gripping or non-skid type of material; and said specific areas being the area directly under each toe, the side opposite the arch of the foot, the base of each toe and beneath the heel of the foot.

2. The lightweight foot garment as defined in claim 1 further comprising a slippery or sliding material applied to said adhesive before hardening.

3. The lightweight foot garment as defined in claim 2 wherein said tubular shaped material further comprises a separate stall for each toe.

4. The lightweight foot garment as defined in claim 1 wherein said first gripping or non-skid type of material forms a plurality of spike shaped elements.

5. The lightweight foot garment as defined in claim 1 further comprising:

a plurality of spike shaped elements embedded within said tubular shaped material.

6. The lightweight foot garment as defined in claim 1 further comprising a second gripping or non-skid material applied to said adhesive before hardening.

7. The lightweight foot garment as defined in claim 6 wherein said adhesive is hot melt glue and said second gripping or non-skid material is ground rubber particles.

8. The lightweight foot garment as defined in claim 6 wherein said second gripping or non-skid type of material forms a plurality of spike shaped elements.

9. The lightweight foot garment as defined in claim 6 further comprising:

a plurality of spike shaped elements embedded within said tubular shaped material.

10. The lightweight foot garment as defined in claim 1 wherein said adhesive is hot melt glue.

11. The lightweight foot garment as defined in claim 10 wherein said tubular shaped material further comprises a separate stall for each toe.

12. A lightweight foot garment comprising:

a tubular shaped material to cover a human foot;

said tubular shaped material being stretchably tight and snug fitting around the foot;

said tubular shaped material having a bottom portion;

an adhesive applied to only specific areas of said bottom portion of said tubular shaped material such that said adhesive is malleable when first applied then hardens into a first gripping or non-skid type of material;

said specific areas being the areas in which a bare human foot would contact the ground; and a plurality of spike shaped elements applied to said adhesive before hardening and further applying said adhesive over said plurality of spike elements.

13. The lightweight foot garment as defined in claim 12 further comprising:

a second gripping or non-skid material applied to said adhesive over said plurality of spike elements before said adhesive hardens.

* * * * *